US005609191A

United States Patent [19]

Topping et al.

[11] Patent Number: 5,609,191

[45] Date of Patent: Mar. 11, 1997

[54] LIQUID TRANSFER APPARATUS

[75] Inventors: Joseph C. Topping, Austin, Tex.; William M. Neeb, Rochester Hills, Mich.

[73] Assignee: Henkel Corporation, Plymouth Meeting, Pa.

[21] Appl. No.: 384,161

[22] Filed: Feb. 6, 1995

[51] Int. Cl.[6] ..... B65B 1/04; B65B 3/04

[52] U.S. Cl. ..... 141/198; 141/95; 141/116; 141/387; 141/192; 137/565; 222/318

[58] Field of Search ..... 141/94, 95, 96, 141/198, 115, 116, 119, 120, 86, 97, 387, 4, 192, 45–48; 417/307; 137/565; 222/318

[56] References Cited

U.S. PATENT DOCUMENTS

| | | | |
|---|---|---|---|
| 2,709,539 | 5/1955 | Swanson, Jr. | 222/108 |
| 2,927,607 | 3/1960 | Bily | 137/615 |
| 3,228,421 | 1/1966 | Sheiry | 137/615 |
| 3,425,464 | 2/1969 | Hughes | 141/115 |
| 3,430,667 | 3/1969 | Hughes | 141/95 |
| 3,874,428 | 4/1975 | Golay | 141/95 |
| 4,205,308 | 5/1980 | Haley et al. | 340/686 |
| 4,206,782 | 6/1980 | Tuson | 137/615 |
| 4,230,161 | 10/1980 | Billington et al. | 141/302 |
| 4,911,212 | 3/1990 | Burton | 141/94 |
| 5,322,092 | 6/1994 | Howeth | 141/4 |
| 5,398,733 | 3/1995 | Welch | 141/4 |

*Primary Examiner*—Henry J. Recla
*Assistant Examiner*—Steven O. Douglas
*Attorney, Agent, or Firm*—Ernest G. Szoke; Wayne C. Jaeschke; Kenneth Watov

[57] ABSTRACT

Apparatus for transferring liquid from a first tank to a second tank having supply line coupled to the first tank, a fill line connected to the second tank, a return line leading to the first tank or a sump, a pump for causing liquid to flow from the supply line to the fill line when the apparatus is in a fill mode, from the fill line to the return line when the apparatus is in a purge mode, and a programmable control for placing the apparatus in a purge mode in response to any one of the following signals, a signal indicating that the fill line is not properly attached to the second tank, a signal indicating that the liquid in the second tank has reached a given level, and a signal that the volume of liquid delivered by the pump is that which will fill the second tank to the given level. The programmable control detects leaks and checks whether the rate at which the pump delivers liquid is within a given range.

20 Claims, 5 Drawing Sheets

LIQUID TRANSFER APPARATUS

FIELD OF THE INVENTION

This invention is in the field of transferring liquid from one container to another, especially hazardous liquid.

BACKGROUND OF THE INVENTION

When it is desired that hazardous liquid be used at different locations in a processing plant, it can be stored in a bulk container and distributed to the locations via piping in accordance with prescribed safety regulations, but this is very expensive and there is always the danger that the piping conducting the liquid will be ruptured. Alternatively, the liquid can be shipped to the plant in portable containers constructed in accordance with safety regulations, that are small and light enough to be transported to the various locations. Unfortunately, however, the construction referred to and the prescribed methods of transportation are extremely expensive.

BRIEF DESCRIPTION OF THE INVENTION

In the liquid transfer apparatus of this invention, liquid is drawn from a bulk tank via a supply line and forced through a fill line leading to a mini-bulk tank when in a fill mode, and drawn from the fill line and forced through a return line leading back to the bulk tank or a suitable sump when the apparatus is in a purge mode. In a standby mode liquid may be drawn through the supply line and forced through the return line. The valves used to place the apparatus in the different modes are normally set so as to place the apparatus in a purge mode, and preferably, programmable control means are provided for the valves so as to place the apparatus in either of the other two modes. In the preferred embodiment of the invention, one pump is used in all modes but in an alternative embodiment, one pump is used in the fill mode and another pump is used in the purge mode.

When a mini-bulk tank is to be filled, it is placed on a grill mounted on top of an overflow reservoir and the free end of the fill line is coupled to it by a cap. The cap is provided with means for producing a signal when the cap is properly attached and means for producing another signal when the liquid in the mini-bulk tank reaches a given level. Means are also provided for producing a flow signal related to the rate of flow of liquid through the pump during the fill mode of operation.

At this point, the programmable control means is reset, and as a consequence the apparatus is set in a purge mode so as to insure that no liquid is in the fill line. This initial purging step could be omitted if one wished to rely on a purging operation that occurs after the mini-bulk tank has been filled.

The control means then checks for a leak between the pump and the fill line by starting the pump and monitoring the flow signal. Because of a normally closed valve in the fill line, liquid flow indicates a leak and the pump is deenergized. If no leak is detected within a short period such as five seconds, the pump keeps running and the control means opens the normally closed valve in the fill line.

A check is then made by the control means as to whether the delivery rate of the pump is within certain limits, and if not, it turns off the pump.

As a safety measure, the control means continues to monitor the flow signal, and if it exceeds the upper limit a leak or other problem is indicated and the pump is turned off.

Greater safety is provided by the control means placing the apparatus in a purge mode if the signal indicating improper attachment of the cap to the mini-bulk tank is present. This can occur at any time during the fill mode.

When a signal indicates that the liquid in the mini-bulk tank has attained a given level, the control means places the apparatus in a purge mode so that no more liquid is pumped to the mini-bulk tank.

As a further measure of safety, the control means places the apparatus in a purge mode when the flow signal indicates that a volume of liquid has been delivered equal to that of a full mini-bulk tank when the given level is reached. Without this redundancy, a failure of the mechanism measuring the level in the mini-bulk tank would result in a continuous overflow until it was noticed and manually turned off by an operator.

Safety is further enhanced by provision of curtains around the grill on which the mini-bulk tank is placed and by attachment of the cap end of the fill line to the outer end of an arm that can be easily pivoted in both the vertical and horizontal planes so as to bring the cap into close proximity with the port in the mini-bulk tank to which it is to be attached. Preferably, the arm is balanced so as to retain any position in which it is placed.

In one embodiment of the invention one pump is used for transferring the liquid from the supply line to the fill line and a separate pump is used for purging the fill line. Preferably, however, one pump is used for both purposes. This is achieved by connecting one end of a shunt line to the fill line, providing a valve that can connect the inlet of the pump to the supply line or to the other end of the shunt line, and a valve for connecting the outlet of the pump to the fill line or to the return line. When the mini-bulk tank is being filled, liquid flows from the supply line, through the pump and into the fill line. When the fill line is being purged, liquid flows from the fill line to the shunt line and through the pump to the return line.

In a preferred embodiment of the invention, a piston displacement pump is used to transfer liquid from the supply line to the fill line, and it is driven by compressed air. An air pressure switch coupled to the air passing through the pump detects pulses that occur at each stroke. The initial setting of pump speed can be conveniently adjusted by a valve while listening to the pump, and the volume pumped or transferred is measured by counting the total number of the pressure changes.

DETAILED DESCRIPTION OF THE DRAWINGS

Figure 1A:
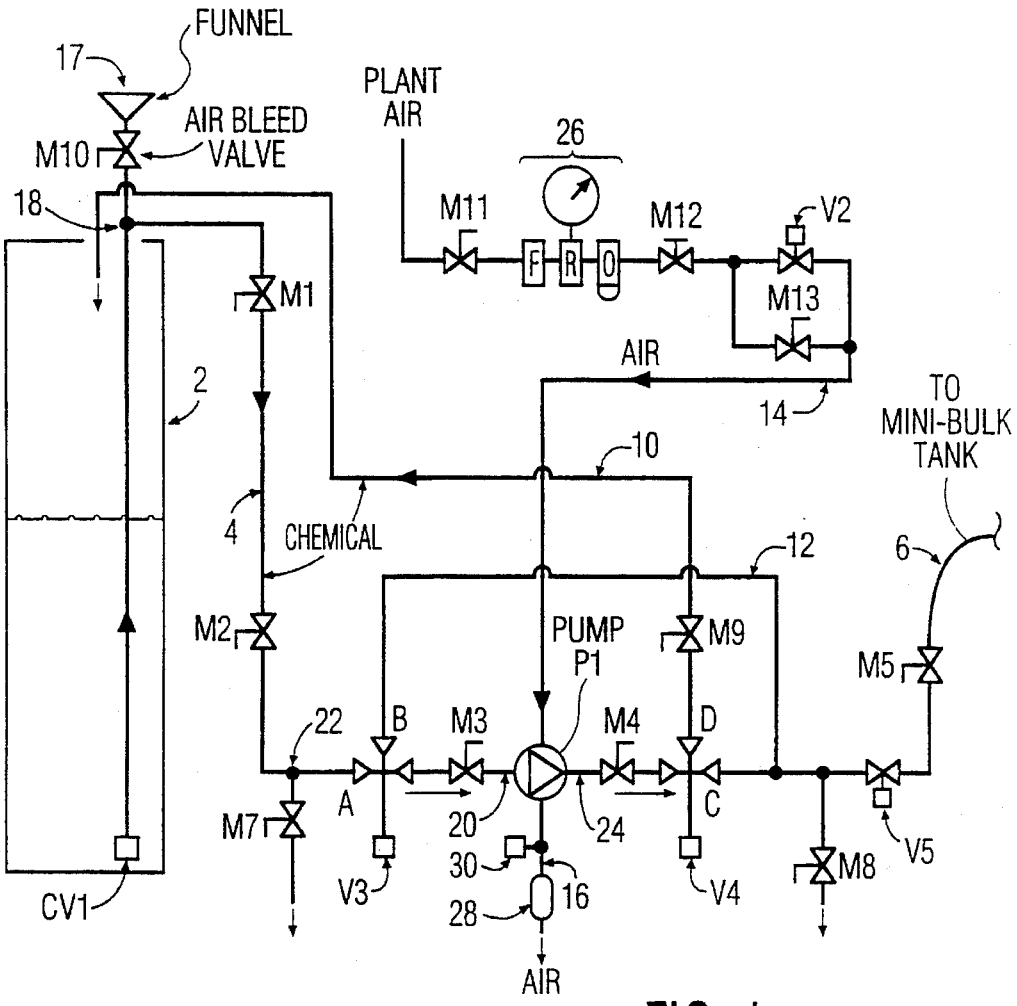
FIG. 1*a* shows a schematic diagram of a liquid transfer apparatus for one embodiment of the invention that uses a single pump for liquid transfer and purging.

The preferred embodiment of the invention shown in FIG. 1*a* is generally comprised of a bulk tank 2 for storing liquid, a supply line 4 that carries liquid from the bulk tank 2 to a pump P1, a fill line 6 that conducts liquid from the pump P1 to a mini-bulk tank 8, a return line 10 for conducting liquid from the fill line 6 or the pump P1 to the bulk tank 2 during the respective purging of the fill line 6 and standby modes of operation, a shunt line 12, an air line 14 for conducting air for operation of the pump P1 and an air exhaust line 16 for the pump. In the following description, a manually operable valve is designated by an M and an automatically controlled valve by a V.

One end of the supply line 4 is placed near the bottom of the bulk tank 2 and is terminated by a check valve CV1. This end of the supply line could be attached to a fitting at the bottom of the bulk tank 2 but that would be another potential source of a leak. Since the pump P1 may be mounted at an elevation near the bottom of the bulk tank 2, the supply line 4 operates as a siphon, and in order that it be free of air, it and the pump P1 can be initially primed by coupling a funnel 17 to the high point 18 of the supply line 4 via an air bleed valve M10 and pouring water or other suitable liquid into the funnel 17 until all air is displaced.

The other end of the supply line 4 is coupled to an inlet 20 of the pump P1 via a manually operable valve M2, one branch A of an automatically controlled two-way valve V3 and a valve M3. A valve M7 couples the junction 22 of M2 and V3 to a sump, not shown.

An outlet 24 of the pump P1 is coupled to one end of the fill line 6 via a valve M4 and a branch C of a two-way automatically controlled valve V4 and to the return line 10 by a branch D. One end of the shunt line 12 is connected to one end of the fill line 6, and its other end is connected to a branch of the valve V3 designated by the letter B.

A valve M8 couples the pump end of the fill line 6 to a sump, not shown, and valves V5, M5 and M6 are connected in the fill line 6 in the order named between the pump end of the fill line 6 and the other end that is inserted in the mini-bulk tank 8. The valve V5 is normally closed.

During a filling mode, the valve V3 connects the inlet 20 of the pump P1 to the branch A and the valve V4 connects the outlet 24 of the pump P1 to the branch C. When the fill line 6 is to be purged, the branch B of the valve V3 is coupled to the inlet 20 of the pump P1 and the branch D of the valve V4 connects the outlet 24 of the pump P1 to the return line 10. Thus during a filling mode liquid flows from the bulk tank 2 to the mini-bulk tank 8 via the supply line 4, the pump P1 and the fill line 6, and during a purge mode, liquid flows from the fill line 6 to the bulk tank 2 via the shunt line 12, the pump P1, and the return line 10. The return line 10 could empty into something other than the bulk tank 2, a static second mini-bulk tank for example. This tank would accumulate all purged liquid, and be available to transport to locations in the facility for consumption.

Although the pump P1 can be energized in other ways, it is safer to use compressed air because closing any valve in the liquid lines during operation will safely stop both the pump P7 and the flow of liquid. The input of the air line 14 is coupled to a source of compressed air in the plant, not shown, and passes to the pump in sequence through a manual air shut-off valve M11, an air filter-regulator-oiler assembly 26, a needle valve M12 and an automatically controlled valve V2. A valve M13 is connected in parallel with the valve V2. Lubrication for the pump P1 is provided by the assembly 26, and the air passing through it is coupled to a muffler 28. If the pump P1 is piston driven, an air pressure switch 30 responds to the pulse of exhaust air occurring at the end of each stroke of the pump so as to provide a control signal s1. These pulses can be counted or integrated to derive the volume that has been delivered, but other types of pumps and measuring devices can be used that provide this information directly.

Figure 2:
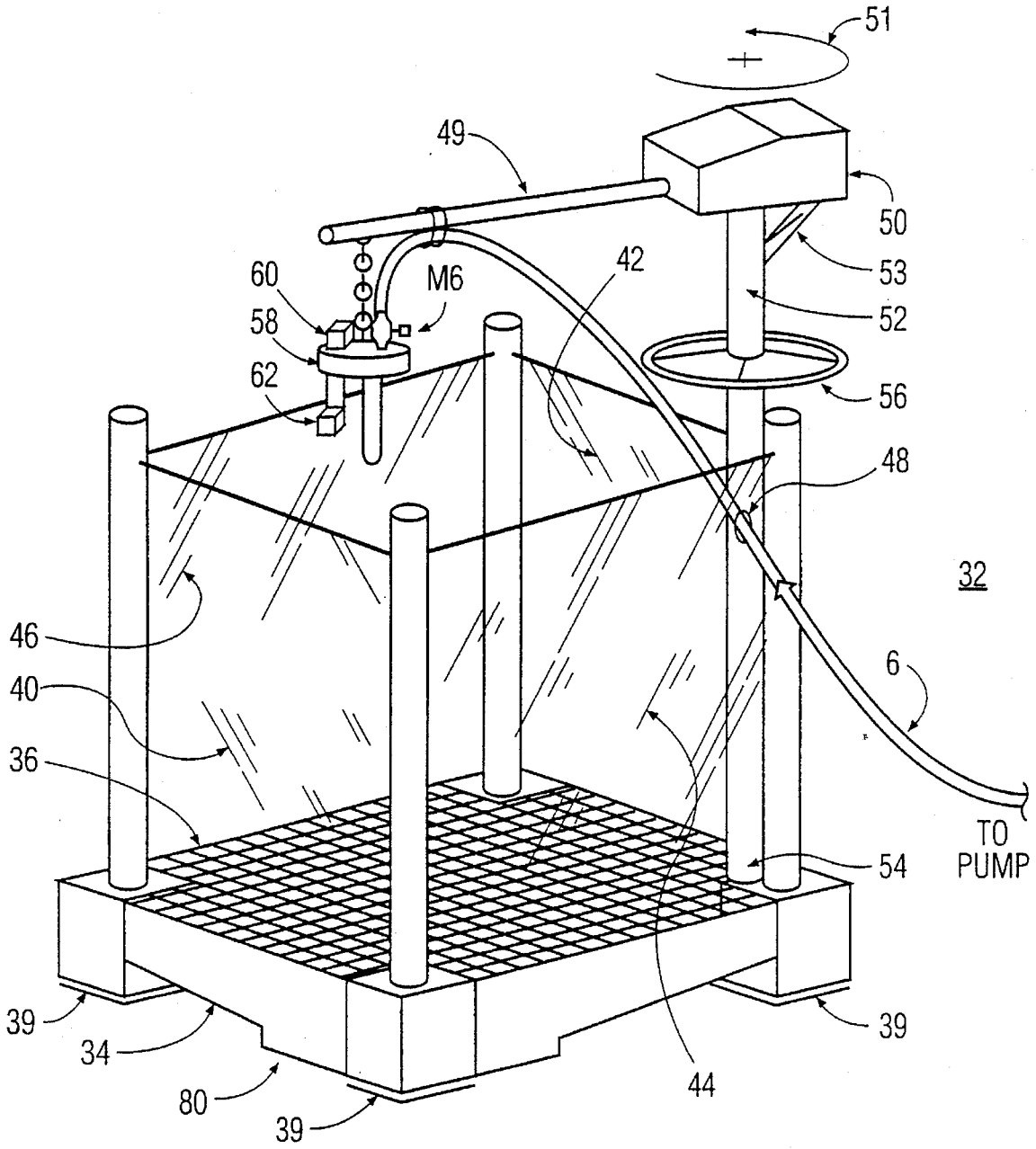
FIG. 2 shows the structure of a mini-bulk tank filling station that protects an operator from exposure to the liquid being transferred.

FIG. 2 shows an enclosure 32 in which a mini-bulk tank is placed during the transfer of liquid to it. The enclosure 32 is comprised of a rectangular base 34 containing a non-metallic grating 36 that is chemically resistant to the liquid being transferred. The base 34 is made of fiberglass and supported by legs 39 at each corner. Transparent curtains 40, 42, 44 and 46 of material that is chemically resistant to the liquid extend upwardly from the four sides of the base 34. The fill line 6 is passed through an opening 48 in the curtain 44 and is attached to one end of a radial arm 49 that is mounted in any suitable manner for rotation about its opposite end in a plane parallel to the grating 36 as well as for rotation in a vertical plane. In this particular embodiment, the arm 49 is attached to a box 50 that pivots about a horizontal axis 51 at the top of a pole 52, and the weight of the fill line 6 at the outer end of the arm 49 is counterbalanced by a spring 53 connected between the pole 52 and the end of the box 50 that is remote from the arm 49. Rotation of the arm 49 in a horizontal plane is achieved by mounting the bottom of the pole 52 in a bearing 54. A handwheel 56 mounted concentrically on the pole 52 provides means enabling an operator to easily turn the pole in a horizontal plane.

A cap 58 at the end of the fill line 6 is provided with any suitable means such as a limit switch 60 for providing a signal s2 when it is fastened to the mini-bulk tank 8 in such manner as to prevent leakage. Also attached to the cap 58 is a sensor 62 for providing a signal s3 when the liquid in the mini-bulk tank 8 is at or above the desired level.

Figure 1B:
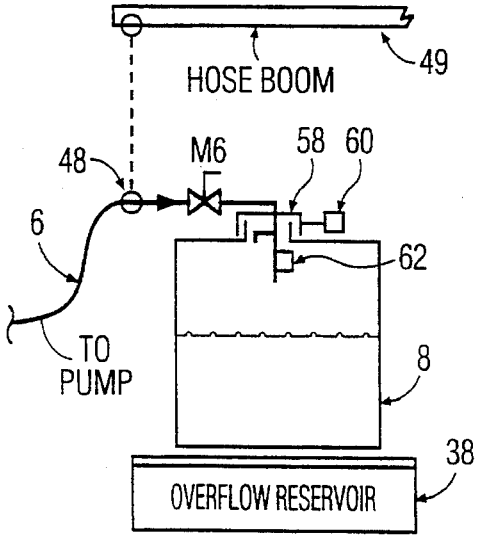
FIG. 1*b* shows a simplified pictorial view of a mini-bulk tank filing station for one embodiment of the invention.
Figure 3:
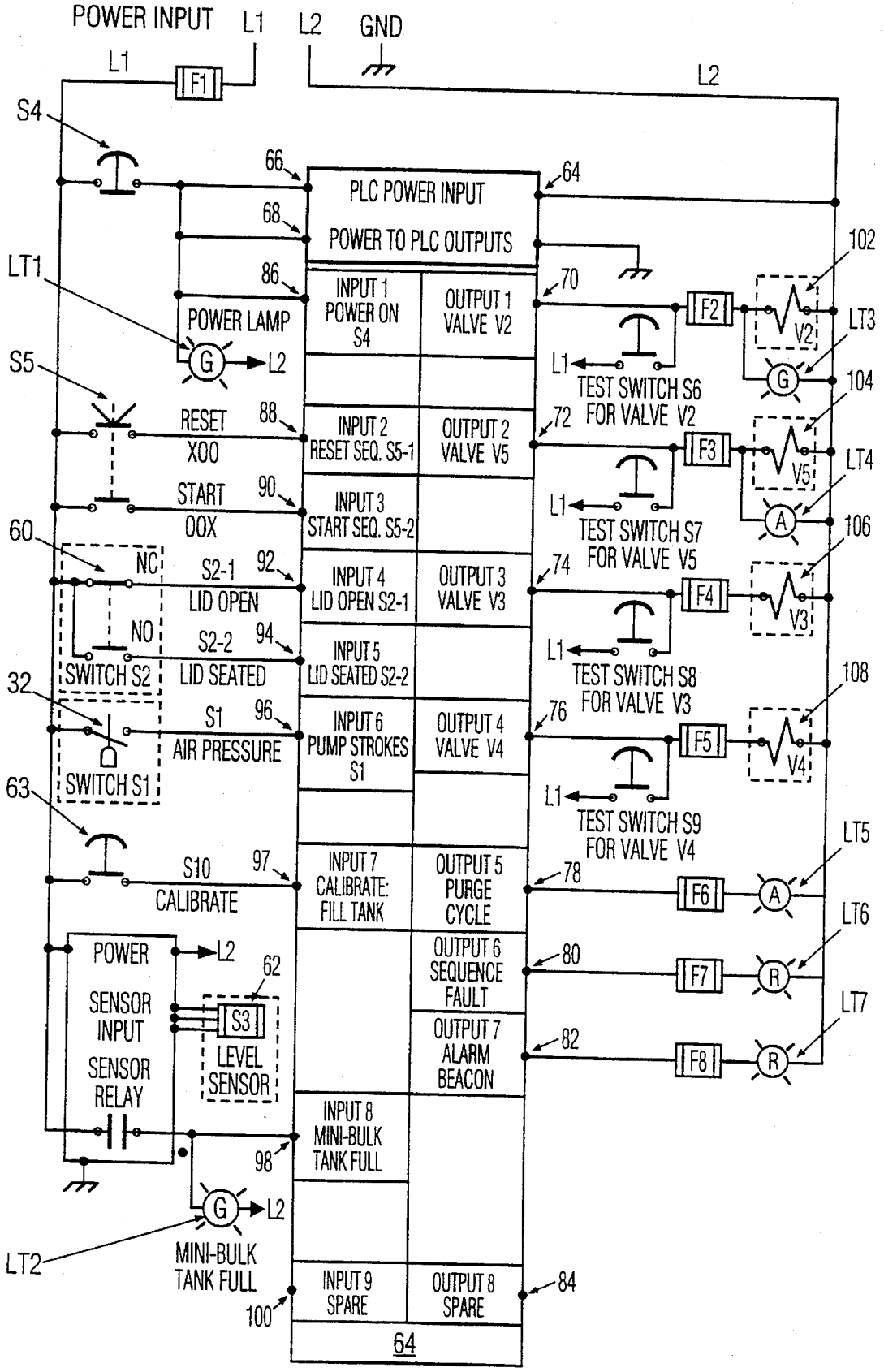
FIG. 3 shows the inputs and outputs of a programmable logic controller (PLC) used to control the system of FIGS. 1*a* and 1*b*.
Figure 4A:
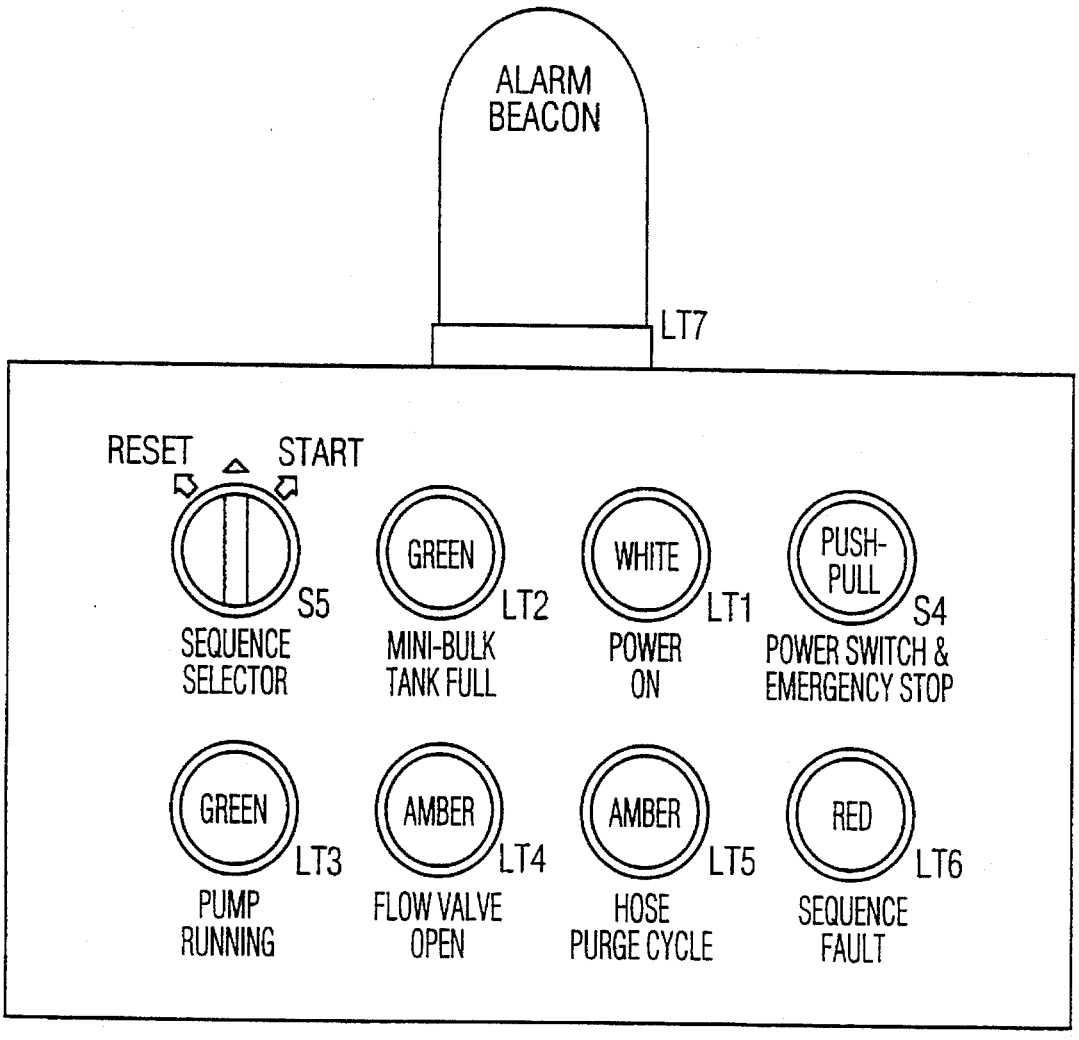
FIGS. 4*a* shows a control panel having switches and lights available to an operator on an exposed front portion.
Figure 4B:
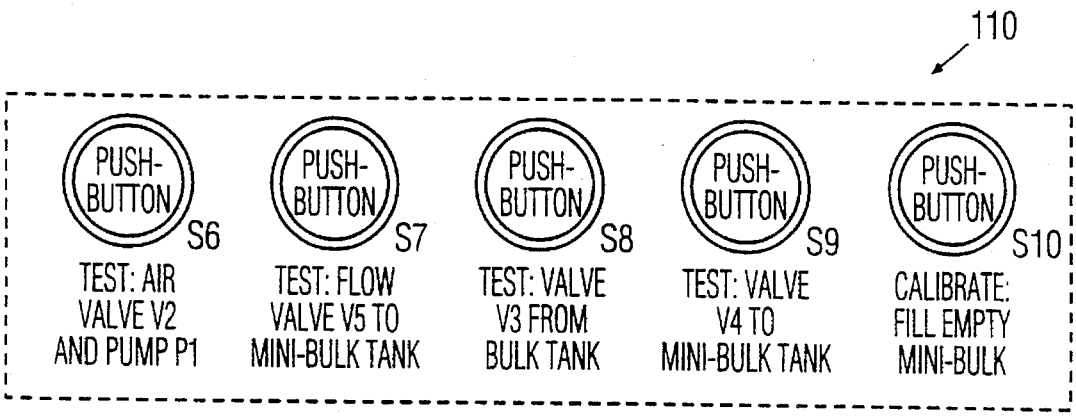
FIG. 4*b* shows an inside or interior portion of the control panel having switches that are only accessible by a person authorized to adjust or repair the apparatus.

Reference is now made to FIGS. 3 and 4 for a description of the manner in which the apparatus of FIGS. 1*a* and 1*b* are to be controlled by a programmable logic controller, PLC, 64 or other programmable unit. Operating voltage for the PLC, as well as for its inputs and outputs, is provided by lines L1, L2 and a ground GND. A switch S4 supplies power when it is pulled out, and all power is removed from the apparatus when it is pushed in. Its output side is connected to a power input terminal 66 for the PLC 64 and an input terminal 68 that is connected by the PLC, when appropriate, to outputs 70, 72, 74, 76, 78, 80, 82, and 84. The output side of S4 is also connected to an input 86 of the PLC 64 that indicates to the PLC whether or not power is being supplied via S4. A white light LT1, also shown in FIG. 4a, is connected between the output of S4 and the line L2 so that it is on when S4 is closed.

Resetting the PLC 64 and starting its procedure are respectively manually controlled by a 3-position switch S5 that is spring loaded to neither reset nor start. When it is pushed to the left, as indicated by X00, voltage on L1 is applied to an input 88 that resets the sequence, and when it is pushed to the right, as indicated by 00X, voltage on L1 is applied to an input 90 that causes the PLC 64 to start its sequence.

When the cap 58 is not securely attached to the mini-bulk tank 8, the limit switch 60 conducts the voltage L1 to an input 92 of the PLC 64, but when the lid is not securely attached to a mini-bulk tank 8, the voltage L1 is applied to an input 94. The presence of L1 at the terminal 92 is a signal s2-1, and the presence of L1 at the terminal 94 is s2-2.

Each time the pump P1 goes through a cycle so as to produce a pulse of exhaust air, the air pressure switch 30 produces an electrical pulse s1 that is applied to an input 96.

The proximity or level sensor switch 62 provides a signal s3 in the form of the voltage L1 to an input 98 of the PLC 64 when liquid in the mini-bulk tank 8 reaches or exceeds a desired level. As shown in FIG. 3, the limit switch 62 activates a relay CR1 that is connected between L1 and the input 98. A light LT2 in the control panel of FIG. 4a is also turned on so as to indicate to an operator that the mini-bulk tank is full. Power for operating CR1 is derived from L1, L2.

Figure 5A:
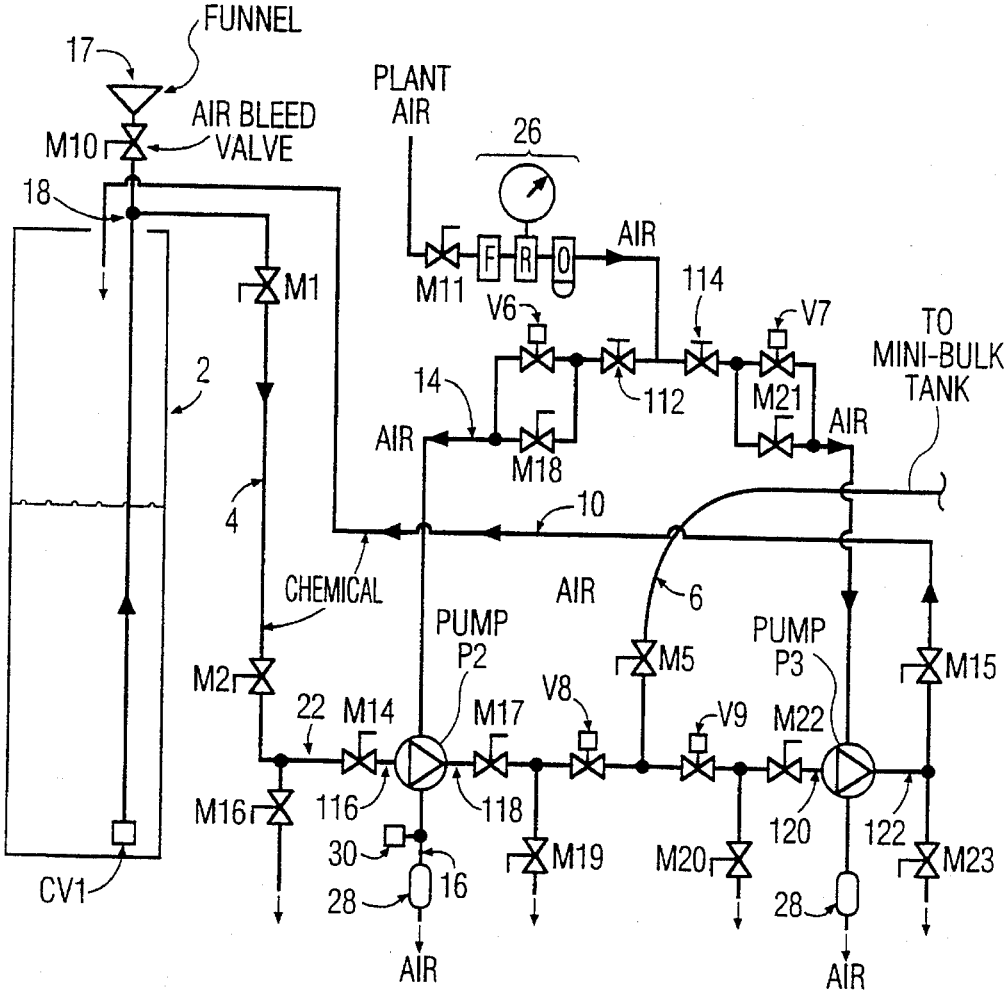
FIG. 5*a* is a schematic diagram of a liquid transfer system for another embodiment of the invention that uses one pump for liquid transfer and another for purging.

A spare output 84 is available for control of a second pump in the embodiment of the invention shown in FIG. 5a if desired.

When the PLC 64 connects L1 to the outputs 70, 72, 74 and 76, current respectively passes through fuse F2, F3, F4 and F5 to a solenoid that opens V2 so as to supply compressed air to the pump P1 and to a green light LT3 in the control panel of FIG. 4a indicating to an operator that the pump P1 is running; to a solenoid 104 that opens the spring loaded normally closed valve V5 and a light LT4 in the control panel of FIG. 4a indicating to an operator that the fill line 6 is open; to a solenoid 106 that causes the valve V3 to move to the position A so as to connect the inlet 20 of the pump P1 to the supply line 4 and to a solenoid 108 that causes the valve V4 to move to the position C so as to connect the outlet 24 of the pump P1 to the fill line 6. The valves V3 and V4 are spring loaded so as to place the valves V3 and V4 in positions B and D such as to direct any liquid back to the bulk tank 2 via the return line 10.

When the apparatus is purging the fill line 6, the PLC 64 connects L1 to the output 78 and via a fuse F6 to a light LT5 on the control panel of FIG. 4a, and if there is a fault in the sequence being performed by the PLC 64, it connects L1 to the output 80 and via a fuse F4 to a light LT6 in the control panel of FIG. 4a.

Should there be an occasion for an alarm, the PLC 64 connects L1 to the output 82 and via a fuse F8 to a light LT7 that is on top of the control panel shown in FIG. 4a.

The switches S4 and S5 as well as all the lights are mounted on the control panel of FIG. 4a so as to be visible to an operator, but manual test switches S6 for operation of V2, S7 for operation of V5, S8 for operation of V3 and S9 for operation of V4 are mounted as indicated by a dashed rectangle 110 so as to be accessible only to authorized personnel. This would permit a knowledgeable person to operate the apparatus manually as may be required in certain maintenance procedures.

Operation

Operation of the apparatus of FIGS. 1, 3 and 4 is as follows.

Setup System

1. Place manual valves in following positions (C=closed, O =open, ADJ=Adjustable):

| M1 | M2 | M3 | M4 | M5 | M6 | M7 | M8 | M9 | M10 | M11 | M12 | M13 |
|---|---|---|---|---|---|---|---|---|---|---|---|---|
| O | O | O | O | C | C | C | C | O | C | O | ADJ | C |

2. Power Switch S4 to OFF.

3. Verify no air in piping from check valve CHK1 to valve M10 to valve M1 to valve M2. Air may have been introduced during piping maintenance. If the pump will not prime, assume that air has broken the siphon over the top of the wall of bulk tank 2.

4. If air in pipe, then remove by the following procedure:

A. Close valve M2.

B. Open valve M10.

C. Pour water or other liquid slowly into funnel, allowing air to escape. Liquid must be compatible with liquid in primary bulk tank 2 and pose no hazard or reaction if it comes in contact with it inside piping. It is not permissible to connect any chemical piping with any other piping in the plant, such as water lines.

D. Close valve M10.

E. Open valve M2.

F. Piping now contains minimal air which will not interfere with maintaining siphon over top edge of primary bulk tank. Air located in downstream piping should not pose a problem.

5. Open manual air supply valve M11 if not already open.

6. Press momentary pushbutton switches S6 and S8 inside control panel of FIG. 4b to permit sucking chemical through piping to pump P1, and returning it to the primary bulk tank through the return piping line 10. These pushbuttons turn on air solenoid valve V2, pump P1, and reposition valve V3 to position A. Adjust the needle valve M12 to make the stroke rate of pump P1 approximately two per second. This can be done by listening to the pump. Note that in some installations, the valve M12 may be located between the air filter-regulator-oiler assembly and the pump P1 as shown, but if the pump stroke rate control is inadequate, it should be relocated to a position between pump P1 and the muffler, so as to stabilize the pumping rate. This will cause the air pressure on the pump diaphragms to be maintained at a higher, more stable pressure throughout each stroke cycle.

Setup Mini-Bulk Tank for Filling

1. Place empty mini-bulk tank on grating 36 atop overflow reservoir 38.

2. Connect flexible fill line 6 at valve M6 to the cap 58 installed on mini-bulk tank.

A. Limit switch 60 will be closed when cap 58 and fill line 6 secured.

B. Level sensor 62 senses when mini-bulk tank is full and provides signal S3.

C. If limit switch 60 is not closed or level sensor 63 indicates that tank is full, so as to provide a signal S3, then sequence cannot be started by placing sequence selector switch S5 into the start position; however, the reset position function is allowed, which will start the purge sequence.

3. Open valves M5 and M6. These may hereafter remain open at all times, at the discretion of the operator and his management.

4. Turn on power to the control panel using power switch S4. This is a red mushroom-head emergency stop switch. Pull to turn unit ON, and push to turn unit OFF.

5. Turn sequence selector switch S5 momentarily to the reset position. This will initiate a purge sequence and also resets internal logic to fill an empty mini-bulk tank.

Start Automatic Filling

1. On the control panel FIG. 4*a*, the following lamps should be lighted:

A. Power on lamp LT1. All other lamps should be off.

B. If sequence fault lamp LT6 is on, then a signal s2 or s3 indicates that the mini-bulk tank is not yet ready to receive liquid.

2. Turn sequence selector switch S5 momentarily to its reset position if this has not yet been selected. The purge sequence will be initiated, but will be completed within approximately one minute. If the fill line 6 has already been purged, this step may be skipped.

3. Turn sequence selector switch S5 momentarily to start position to start filling operation.

4. Valve V3 moves to position A to connect liquid supply line 4 from bulk tank 2 to pump P1.

5. Valve V4 moves to position C to connect P1 to the fill line 6 leading to the mini-bulk tank.

6. After 5-second delay, air solenoid valve V2 opens to energize P1 and the pump running lamp LT3 turns on. If air pressure switch 30 detects more than one pulse, system faults, indicating a possible leak or mispositioned valve. Valves V3 and V4 return to their original positions B and D respectively so as to place the apparatus in a purge state, the air solenoid valve V2 closes so as to turn off P1, the sequence fault lamp LT6 flashes, and the alarm beacon LT7 illuminates. No further sequences will occur.

7. After a second 5-second delay, permissive flow valve V5 opens to permit liquid to flow and flow valve lamp LT4 turns on.

8. Liquid is pumped to mini-bulk tank 8.

9. Four automatically sensed conditions will stop the filling sequence and commence the purge sequence.

A. If limit switch 60 indicates the cap 54 is not in place, this will energize fault sequence lamp LT6 and alarm beacon LT7.

B. If air pressure switch 30 senses pump stroke rate less than one stroke per second or greater than three strokes per second. (Other values may be used for this comparison test, based upon specific hardware selections.)

C. If air pressure switch 30 counts a total of strokes by P1 equivalent to the filling of one empty mini-bulk tank, this indicates that the tank should be full.

D. If level sensor 62 provides a signal s3 which indicates mini-bulk tank 8 is full. This will energize the tank full lamp LT2.

10. If at any time the power is interrupted or the emergency stop switch S4 is pressed, the system will reset all valves to their rest position and turn off the valve control outputs of the PLC 64 until a reset or start is selected using the sequence selector switch S5. All valves are spring-loaded to return for safety reasons to their standby position when power is removed.

Calibration Sequence

The internal counter which measures the volume of chemical pumped can be recalibrated by filling an empty mini-bulk tank 8 using the following sequence.

A. Place empty mini-bulk tank 8 on grating 36 atop overflow reservoir 38 (see FIG. 1*b*).

B. Follow all preceding steps required to commence filling mini-bulk tank, but do not operate any electrical switches.

C. Turn sequence selector switch S5 momentarily to the reset position. This will initiate a purge sequence and also resets internal logic to fill an empty mini-bulk tank.

D. Press calibrate pushbutton S10 momentarily to start a filling sequence. All features of the filling sequence previously described after sequence selector switch S5 is turned to the start position will apply, except that the feature that will normally halt the filling sequence based upon counting pulses of air with air pressure switch 30 is disabled. When the solution in the mini-bulk tank reaches the level sensor 62 indicating the mini-bulk tank is full, the filling sequence will stop and the purge sequence will start. In this calibration sequence, however, the number of counts of air pressure switch 30 which was measured during this filling sequence will be inputted into the PLC memory so that this becomes the new value of pulses which represents the shutoff point. This technique eliminates the requirement to count the pulses and manually adjust the counter setpoint.

Purge Sequence

The purge sequence withdraws nearly all liquid in the fill line 6 between valves V5 and M6 by using the pump P1 and repositioning valves V3 and V4. The physical orientation of the fill line 6 must be arranged to maximize the efficiency of the purge sequence.

1. This sequence is initiated by one of the following five conditions:

A. If limit switch 60 indicates the cap 54 is not in place, this will energize fault sequence lamp LT6 and alarm beacon LT7.

B. If air pressure switch 30 senses pump stroke rate less than one stroke per second or greater than three strokes per second. (Other values may be used for this comparison test, based upon specific hardware selections.)

C. If air pressure switch 30 counts a total of strokes by P1 equivalent to the filling of one empty mini-bulk tank, this indicates that the tank should be full.

D. If level sensor 62 provides a signal s3 which indicates mini-bulk tank 8 is full. This will energize the tank full lamp LT2.

E. At all times, turning sequence selector switch S5 momentarily to the reset position will stop the filling process and initiate the purge sequence.

The purge sequence will be halted by one of the following conditions:

F. Power switch S4 is turned off.

G. Power source is disconnected from control panel of FIG. 4*a* or fuse F1 is blown.

H. Pump stroke rate exceeds three pulses per second for five seconds. (These parameters may be modified depending upon specific hardware selection.) During the purge sequence, purge lamp LT5 will flash.

2. Stop pump P1 by turning off air solenoid valve V2.

3. Close permissive flow valve V5 to fill line 6.

4. Move valve V3 to position B.

5. Move valve V4 to position D.

6. Turn on pump P1 by turning on air solenoid valve V2.

7. Open permissive valve V5 to permit suction from fill line 6.

8. Pump liquid from fill line 6 until pump rate exceeds three pulses per second for five seconds. (see note in Item 1-H above.)

9. Turn off air solenoid valve V2 to stop pump P1.

10. Close permissive flow valve V5 to fill line 6.

11. Turn off fill line 6 purge lamp LT5. Lamps LT3, LT4, and LT5 are off.

12. Remove connection of the fill line 6 from the cap 54 on top of the mini-bulk tank and remove tank from the grating 36 on top of overflow reservoir 38. Prior to moving or handling the mini-bulk tank 8, rinse any liquid spills with water from a water hose, rinsing the fill hose 6, fittings, and the top of the mini-bulk tank 8. Rinsed water will flow into the overflow reservoir 38, which must be manually drained periodically. An overflow pipe should be connected from a high level in the overflow reservoir 38 to a chemical waste sump in the event of a catastrophic leak. The residual empty volume of the overflow reservoir 38 must never be less than 110% of the total volume of the largest mini-bulk tank 8.

When the sequence fault light LT6 comes on, the alarm beacon LT7 is also lit. If desired, the PLC 64 can be programmed to cause the LT6 to produce repeated sequences of a number of flashes corresponding to a given fault.

The alarm beacon LT7 can be relocated from the control panel to a position which is visible over a larger area of the facility.

Another level sensor, not shown, that is like the level sensor 62 for the mini-bulk bottle could be used to sense the level of liquid in the overflow reservoir 38 and couple a signal to the input 100 of the PLC 64 when it reached a given point. The PLC 64 would be programmed to initiate the purge sequence and turn on the fault light LT6 and the alarm beacon LT7. An audible alarm could also be sounded.

Figure 5B:
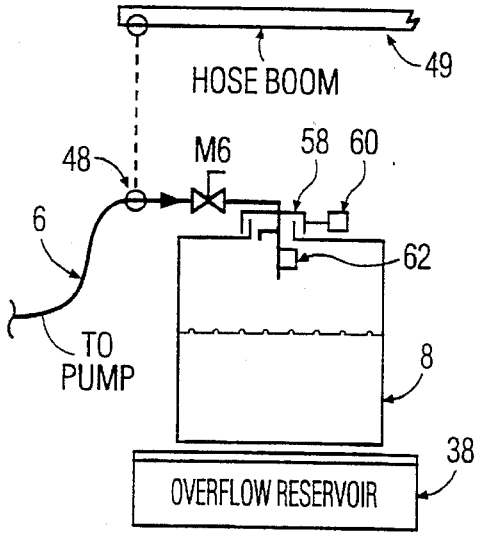
FIG. 5*b* is a simplified pictorial view of a mini-bulk tank filling station for another embodiment of the invention.

Reference is now made to the schematic representation of an alternative embodiment of the invention shown in FIGS. 5*a* and 5*b* in which elements having the same function as in FIGS. 1*a* and 1*b* are designated in the same way. Note that FIGS. 5*b* and 1*b* are identical, and that each embodiment uses the same mini-bulk tank filling station configuration. Instead of a single pump for filling a mini-bulk tank and purging the fill line 6 leading to it, two pumps are used, a pump P2 for the filling operation and a pump P3 for the purging operation. A single air filter-regulator-oil assembly is provided for both P2 and P3, but separate needle valves 112 and 114, and separate on/off valves V6 and V7 are used. Since the pump P2 is only used during filling of a mini-bulk tank 8, only a one-way manual valve M14 is required at the inlet 116 of the pump P2 and a spring loaded normally closed valve V8 is required at its output 118. The valve V8 normally prevents flow into the fill line 6 just as V5 did in FIG. 1*a*. The inlet 120 of the pump P3 is coupled to the fill line 6 via V9, and its outlet 122 is coupled via M15 to the return line 10. One skilled in the art could readily program a PLC to control the valves V6, V7, V8 and V9. Note that manual valves M16 through M23 are included for maintenance purposes to isolate various portions of the system in a safe manner, for permitting repair or inspection of the isolated portion.

Although the siphoning action caused by the supply line 4 passing over the top of the bulk tank 2 eliminates a potential source of a leak that would be present if the supply line were directly coupled to the bottom portion of the bulk tank 2, the latter coupling could be used in which event it would not be necessary to prime the pump P1. This would also eliminate the need for the valve M10, the funnel 17 and the check valve CV1.

Although various embodiments of the invention are shown and described herein, they are not meant to be limiting. Those of skill in the art may recognize modifications to these embodiments, which modifications are meant to be covered by the spirit and scope of the appended claims.

What is claimed is:

1. Apparatus for transferring liquid from a bulk storage tank to a mini-bulk tank comprising:

a supply line having one end adapted to be coupled to said bulk storage tank;

a return line connected at one end to discharge liquid into said bulk storage tank;

a fill line having one end adapted to be coupled to said mini-bulk tank;

means for pumping liquid from the other end of said supply line to the other end of said fill line and to said mini-bulk tank when the apparatus is in a fill mode;

means for pumping liquid from the other end of said fill line through said return line to said bulk storage tank when the apparatus is in a purge mode;

means for changing the apparatus from one mode to another;

a raised platform for supporting said mini-bulk tank during liquid transfer thereto; and moveable arm means for supporting and accurately positioning said coupling means to facilitate the coupling of said fill line to said mini-bulk tank.

2. Apparatus as set forth in claim 1, further comprising:

means for providing a first signal indicative of the volume of liquid that has been pumped when the apparatus is in a fill mode;

means for providing a second signal indicating if said one end of said fill line is properly connected to said mini-bulk tank;

means for providing a third signal indicating that liquid in the mini-bulk tank has reached a given level; and means for transferring the apparatus from a fill mode to a purge mode in response to any of the following: the first signal indicating that a given volume of liquid has been pumped; the second signal indicating that the fill line is not secured to a tank being filled; the third signal indicating that the liquid in the mini-bulk tank has reached a given level.

3. Apparatus as set forth in claim 2, further comprising:

means for disabling said means for pumping when the apparatus is in a fill mode if the first signal indicates that the rate of pumping lies outside given limits.

4. Apparatus as set forth in claim 2, further comprising:

means for closing said fill line when the fill mode is initiated;

means for disabling said means for pumping liquid to the other end of said fill line if the first signal indicates during a given period that liquid in said mini-bulk tank has risen to a predetermined level; and means for opening the fill line if the second signal indicates that liquid is not being pumped.

5. Apparatus as set forth in claim 1, further comprising:

valve means for selectively placing said apparatus in the purge or fill modes, said valve means being spring loaded to place said apparatus in the purge mode in a fail-safe manner.

6. Apparatus for transferring liquid from a bulk tank to a mini-bulk tank comprising:

a supply line having a first end adapted to be coupled to said bulk storage tank;

a fill line having a first end adapted to be coupled to said mini-bulk tank;

a return line connected at a first end to discharge liquid into said bulk storage tank;

means for pumping liquid from a second end of said supply line into a second end of said fill line;

means for providing a signal indicating when a given volume of liquid has been transferred from said supply line to said fill line;

means for pumping liquid from the second end of said fill line into a second end of said return line in response to said signal; and moveable arm means for supporting and accurately positioning said coupling means to facilitate the coupling of said fill line to said mini-bulk tank.

7. Apparatus as set forth in claim 6, wherein said means for providing said signal operates in response to the volume of liquid pumped.

8. Apparatus as set forth in claim 6, wherein said means for providing said signal operates in response to the amount of liquid contained in a mini-bulk tank being filled.

9. Apparatus as set forth in claim 6, wherein said means for pumping liquid from said fill line to said return line in response to said signal comprises:

a pump coupled between said fill line and said return line; and means for disabling said means for pumping liquid from said supply line to said fill line.

10. Apparatus as set forth in claim 6, wherein said means for pumping liquid from said fill line to said return line in response to said signal comprises:

a shunt line having one end coupled to the second end of said fill line;

means for coupling said means for pumping between the second end of said shunt line and the second end of said return line; and means for cutting off liquid flow from said pumping means to said fill line.

11. Liquid transfer apparatus comprising:

a supply line;

a fill line;

a return line;

a shunt line having one end coupled to said fill line;

a pump having an inlet and an outlet;

first valve means for selectively coupling said inlet to one end of said supply line or the other end of said shunt line;

second valve means for selectively coupling said outlet to one end of said return line or to one end of said fill line;

whereby, depending on the positions of said first and second valve means, liquid can be pumped from said supply line to said return line, from said supply line to said fill line, or from said fill line via said shunt line to said return line;

means for coupling the other end of said fill line to a mini-bulk tank to which liquid is to be transferred;

means for providing a first signal indicating when said means for coupling is securely coupled to a mini-bulk tank;

means for providing a second signal indicating when a given amount of liquid is in said mini-bulk tank;

means for preventing said pump from pumping when said first signal indicates that said means for coupling is not securely coupled to said mini-bulk tank; and means for disabling said pump when said second signal indicates that the said given volume of liquid is in said mini-bulk tank.

12. Liquid transfer apparatus as set forth in claim 11 further comprising:

means for providing a third signal indicating the volume of liquid that said pump has pumped; and means for disabling said pump when said third signal indicates that the pump has pumped a predetermined volume.

13. Liquid transfer apparatus as set forth in claim 11, further comprising:

a bulk storage tank having a bottom, and a top that is above said first valve means;

said supply line extending from said first valve means over the top of and into said bulk storage tank, the other end of said supply line being adjacent the bottom of said bulk storage tank so as to form a siphon having a high point where the supply line passes over the top of said bulk storage tank; and means for introducing liquid at the high point of said siphon for priming said pump.

14. The liquid transfer apparatus as set forth in claim 11, further comprising:

a raised platform for supporting said mini-bulk tank during liquid transfer thereto; and moveable arm means for supporting and accurately positioning said coupling means to facilitate the coupling of said fill line to said mini-bulk tank.

15. The liquid transfer apparatus as set forth in claim 14, wherein said moveable arm means includes:

a spring loaded lifting assembly secured to a side portion of said platform;

an elongated arm having one end secured to said lifting assembly, and an opposite end adapted for holding a portion of said coupling means; and a handwheel included in said lifting assembly for permitting manual movement of said arm for locating said coupling means directly over said mini-bulk tank.

16. The liquid transfer apparatus as set forth in claim 14, further including:

a grating included as a floor for said platform; and a containment pan located under said grating for catching liquid spilled or dripped during filling of said mini-bulk tank.

17. The liquid transfer apparatus as set forth in claim 16, further including:

a safety railing system secured to and around the circumference of said platform; and chemically resistant splash curtains secured to said railing system, for preventing the splashing of liquid beyond said platform.

18. The liquid transfer apparatus as set forth in claim 11 further including:

means for calibrating said apparatus to automatically fill a mini-bulk tank with a measured amount of liquid.

19. Liquid transfer apparatus for transferring liquid from a storage tank comprising:

a supply line;

a fill line;

a shunt line;

a return line adapted to be coupled at one end to the storage tank;

a pump having an inlet and an outlet;

first valve means for selectively coupling said inlet of said pump to one end of said supply line or to one end of said shunt line;

the other end of said shunt line being coupled to said fill line; and second valve means for selectively coupling the outlet of said pump to one end of said fill line or to one end of said return line;

whereby liquid may be delivered by said pump from said supply line to said return line, from said supply line to said fill line, or purged from said fill line to said return line depending on the coupling provided by said first and second valve means.

20. A method for transferring liquid from a bulk tank to a mini-bulk tank comprising the steps of:

drawing liquid from a bulk tank via a supply line;

moving a mechanical arm supporting a fill line, for accurately positioning a coupling device to couple it to an input port of said mini-bulk tank, for coupling one end of a fill line to said mini-bulk tank;

connecting another and of said fill line to a discharge end of said supply line;

detecting if said coupling device is securely coupled to said mini-bulk tank;

forcing a flow of the liquid into a mini-bulk tank via said fill line only if the fill line is securely coupled to the mini-bulk tank; and purging liquid from the fill line in response to the mini-bulk tank being filled to a predetermined level.

* * * * *